United States Patent [19]

Seneca

[11] Patent Number: 4,501,026

[45] Date of Patent: Feb. 26, 1985

[54] BELT-LIKE ORNAMENTAL MEMBER

[76] Inventor: Joseph T. Seneca, 401-Rte. 22 Regency Village, North Plainfield, N.J. 07060

[21] Appl. No.: 522,807

[22] Filed: Aug. 15, 1983

[51] Int. Cl.[3] ..... A41C 19/22

[52] U.S. Cl. ..... 2/308

[58] Field of Search ..... 2/308, 301, 322, 318, 2/323; 128/524, 508

[56] References Cited

U.S. PATENT DOCUMENTS

| | | | |
|---|---|---|---|
| 1,830,302 | 11/1931 | Townsend | 2/308 |
| 2,713,340 | 7/1955 | Meminger | 128/96 |
| 2,727,247 | 12/1955 | Bailey | 2/323 |
| 2,975,431 | 3/1961 | Panepinto | 2/301 |
| 3,116,736 | 1/1964 | Alberts | 128/524 |
| 3,184,883 | 5/1965 | McCook | 46/32 |
| 3,314,421 | 4/1967 | Wingard | 128/102 |

*Primary Examiner*—Doris L. Troutman

*Attorney, Agent, or Firm*—James & Franklin

[57] ABSTRACT

The central sections of first and second elongated string-like portions are connected by a knot. The first portion carries decorative end elements and includes first and second parts adapted to extend in opposite directions from the rear to the front of the pants to encircle the waistband in belt-like fashion. The ends of the first and second parts are tied together. The second portion is adapted to extend downwardly from the knot, between the leg portions of the pants, and upwardly along the front thereof. The second portion includes third and fourth parts adapted to be clipped onto the first and second parts, respectively, at spaced locations along the first portion on either side of the point where the first and second parts are tied or onto spaced belt loops across the front of the waistband. In a second embodiment, a fifth string-like part connects the first and second parts with the third and fourth parts.

18 Claims, 11 Drawing Figures

FIG. 5
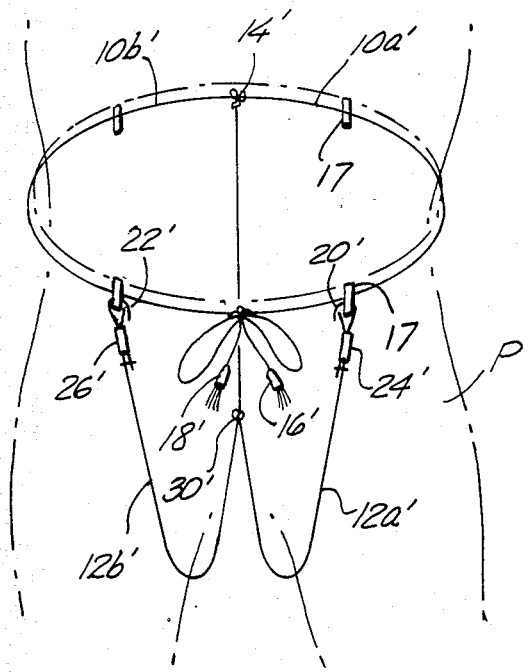
FIG. 6
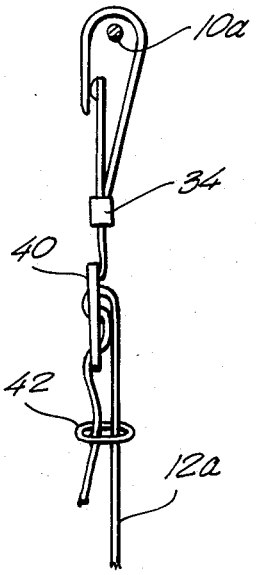
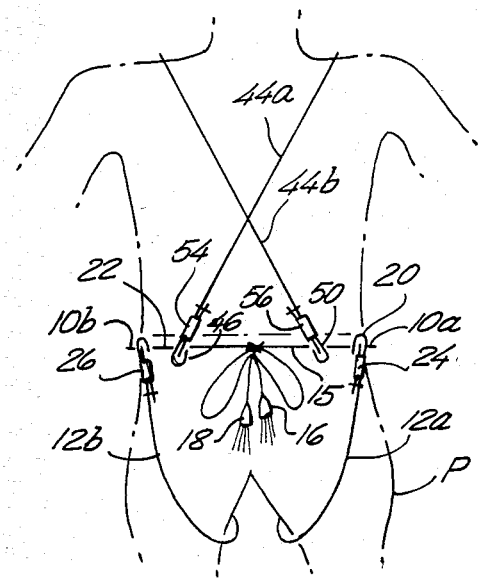
FIG. 7
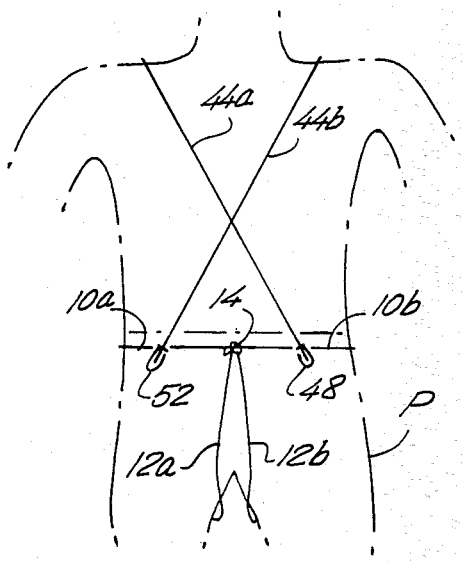
FIG. 8

FIG. 9
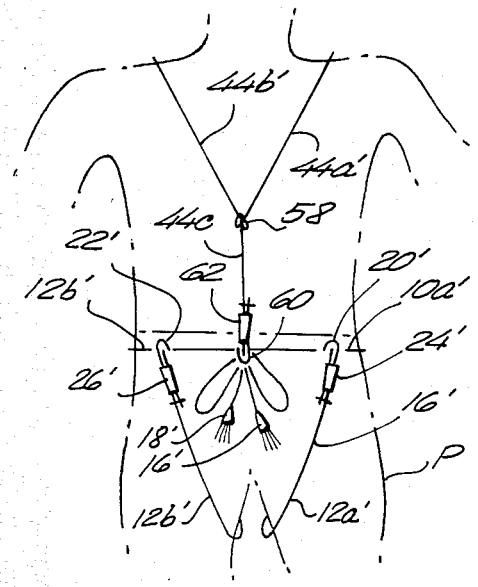
FIG. 10
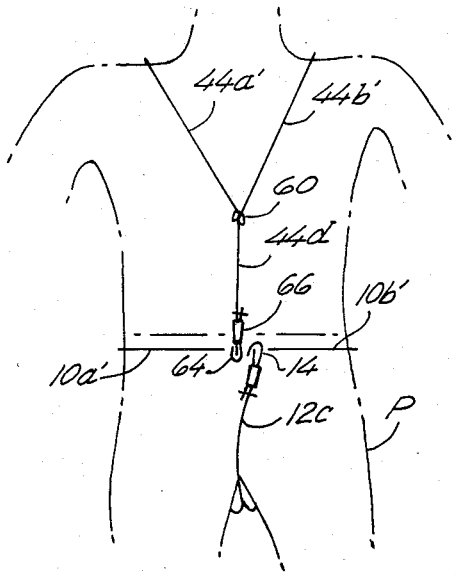
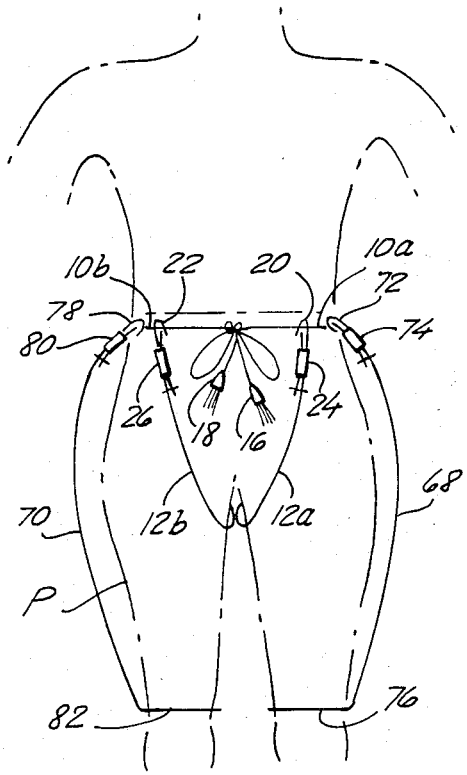
FIG. 11

BELT-LIKE ORNAMENTAL MEMBER

The present invention relates to an ornamental member for external use with garments and, more particularly, to a belt-like ornamental member for use over pants which serves both to decorate and to highlight the contours of the body of the wearer.

Belts made of a single strip of matrial designed to encircle the waistband of pants in order to secure the pants to the body of the wearer have long been known. Such belts have also, in some instances, been used for decorative purposes by ornamenting the exterior surface with designs, different colors, and the like.

Belt-like members have also been used under garments as means for supporting trousers and the like from the interior and for supporting various portions of the body. Athletic supporters and girdles fall into the latter category. In some instances, athletic supporters which, of course, are designed to be worn under pants, have included portions which extend between the legs of the wearer for support.

In these days of high fashion clothing, particularly pants such as designed jeans and the like, individuals are extremely conscious of the manner in which pants look and fit. There is a need for an ornamental member designed for use over the pants which encircles the waistband of the pants in a belt-like fashion, carries decorative elements to enhance the appearance of the garment, and has a portion which extends along the rear of the pants, between the legs, to the front thereof which defines and emphasizes the contours of the body.

It is, therefore, a prime object of the present invention to provide a belt-like ornamental member for use adjacent the external surface of a garment such as pants, which is decorative and defines and emphasizes the contours of the body.

It is another object of the present invention to provide a belt-like ornamental member which includes a first portion adapted to encircle the body in belt-like fashion, and a second portion extending along the seat of the pants, between the legs, to the front of the encircling portion.

It is another object of the present invention to provide a belt-like ornamental member which is adjustable to fit all sizes.

It is another object of the present invention to provide a belt-like ornamental member adapted to carry one or more of a variety of different decorative elements, such as tassels, balls, weights, or the like.

It is another object of the present invention to provide a belt-like ornamental member of simple construction which can be manufactured and sold inexpensively.

It is a further object of the present invention to provide a belt-like ornamental member, the design of which can be varied in order to suit a wide variety of decorative purposes.

In accordance with the present invention, an ornamental member is provided for use over a garment such as pants, having a waistband and leg portions. The member comprises a first portion, a second portion, and means for connecting the first portion to the second portion. The first portion comprises first and second parts adapted to extend in opposite directions from the rear of the waistband to the front thereof to encircle the waistband, the ends of the first and second parts being joined together such as by tying. The second portion is adapted to extend downwardly from the connecting means, between the leg portions of the pants and upwardly along the front thereof. The second portion comprises third and fourth parts adapted to be connected, at spaced locations along the front of the garment at either side of the point where the first and second parts are joined.

The member also includes first and second decorative elements. The decorative elements are situated on the ends of the first and second parts, respectively.

The member also preferably includes first and second clip means. The clip means are situated on the ends of the third and fourth parts and are adapted to releasably connect the ends of the third and fourth parts with the first portion or with spaced belt loops along the front of the waistband.

The member also includes means associated with each of the third and fourth parts for adjusting the length thereof. In this manner, the member can be easily adjusted to fit all size individuals.

The first and second portions each comprise a single string-like member. The string-like members may each comprise two or more braided strands.

The second portion may, in addition, include a connecting part. The connecting part extends between the connecting means, on the one hand, and the third and fourth parts, on the other hand.

The connecting means preferably comprises a knot. However, the connecting means may alternatively comprise means for adjustably positioning the second portion relative to the first portion.

The member may include a first accessory portion adapted to extend from a point on the first portion along the rear of the waistband, over the shoulders of the wearer, to a point on the first portion along the front of the waistband. The first accessory portion comprises fifth and sixth parts, each of which extend over a different shoulder of the wearer. The fifth and sixth parts cross over each other. The first accessory portion may, in addition, include a seventh part connecting the first portion with the fifth and sixth parts.

The member may also include a second accessory portion. The second accessory portion comprises eighth and ninth parts, each of which extends from a different spaced point on the first portion, along the exterior of the leg of the garment and encircles a different leg of the garment at a point spaced from the waistband.

To these and to such other objects which may hereinafter appear, the present invention relates to a belt-like ornamental member, as described in the following specification and recited in the annexed claims, taken together with the accompanying drawings, wherein like numerals refer to like parts, and in which:

FIG. 5 is a front view of the second preferred embodiment of the present invention showing same in use on a garment;

FIG. 6 is an enlarged view illustrating the clip means and size adjustment means of the present invention;

FIG. 7 is a front view of the first embodiment of an over-the-shoulder accessory portion of the present invention;

FIG. 8 is a rear view of the over-the-shoulder accessory portion of the present invention shown in FIG. 7;

FIG. 9 is a front view of an alternate embodiment of the over-the-shoulder accessory portion of the present invention;

FIG. 10 is a rear view of the alternate embodiment of the over-the-shoulder accessory portion of the present invention; and FIG. 11 is a front view of the preferred embodiment of a leg accessory portion of the present invention.

Figure 1:
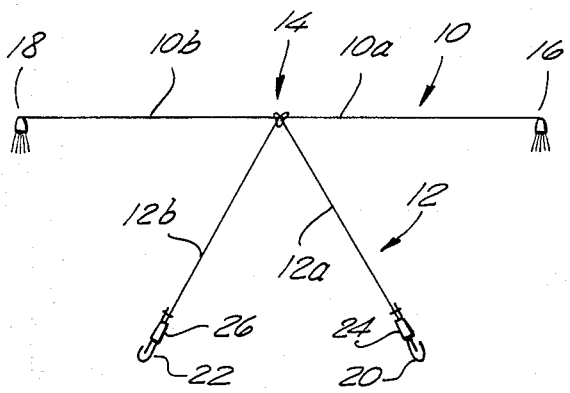
FIG. 1 is a plan view of the first preferred embodiment of the present invention.

As shown in FIG. 1, the first preferred embodiment of the present invention comprises a first portion 10, a second portion 12, and connecting means 14. First portion 10 comprises a single string-like element divided into two parts 10*a* and 10*b* by connecting means 14. Second portion 12 comprises a single string-like element divided into two parts 12*a* and 12*b* by connecting means 14. Connecting means 14 preferably comprises a knot whereby second portion 12 is joined to the central section of first portion 10.

Portions 10 and 12 can be made of any material such as a single strand or multiple braided strands of fabric, leather, plastic, or the like. Alternatively, portions 10 and 12 can be made of a beaded string or chain or the like.

Decorative elements 16 and 18 are situated at the ends of parts 10*a* and 10*b*, respectively. Decorative elements 16 and 18 can be tassels, as shown, or balls, weights, or any other object which visually coordinates in a pleasing manner with the pants over which the member is worn.

At the ends of parts 12*a* and 12*b* are situated clips 20, 22 which may take the form of a hook, clamp, alligator-type clip, or any other type of releasable connecting means. In addition, each of the parts 12*a* and 12*b* is provided with a means 24, 26 to adjust the length thereof. Means 24 and 26 can comprise any type of commonly known size adjusting means, such as those used on brassiere straps, suspenders, conventional belts, or the like.

Figure 2:
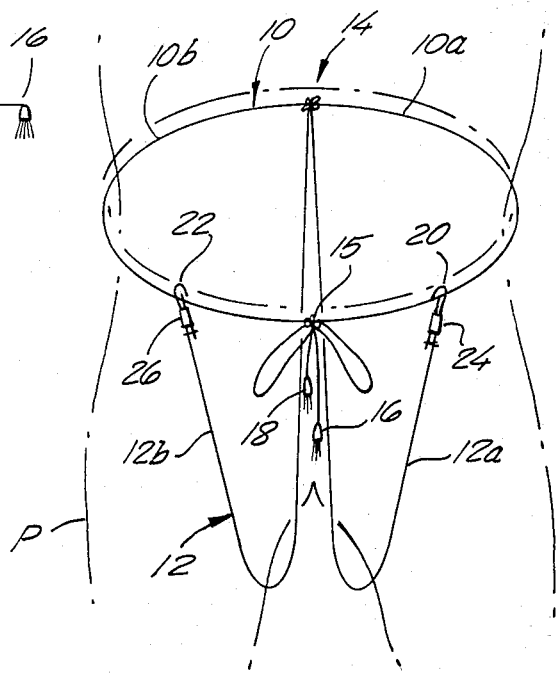
FIG. 2 is a front view of the first preferred embodiment of the present invention showing same in use on a garment.

FIG. 2 illustrates the manner in which the first preferred embodiment of the present invention is used on a garment such as pants P having a waistband and leg portions. Connecting means 14 is situated at the central section of the rear of the waistband. Parts 10*a* and 10*b* extend in opposite directions from connecting means 14 around the waistband to the front thereof to encircle the garment. Parts 10*a* and 10*b* may pass through the belt loops on the waistband, if present. Parts 10*a* and 10*b* are then joined together, such as by tying in a bow 15 or the like, at the central section of the front of the waistband, such that the free ends thereof carrying decorative elements 16 and 18 extend downwardly along the front of the pants.

Parts 12*a* and 12*b* extend downwardly from connecting means 14, along the central seam of the seat of the pants, between the legs, and upwardly along the front of the pants. Parts 12*a* and 12*b* are then connected to parts 10*a* and 10*b*, respectively, at spaced locations along portion 10 at either side of the point 15 where parts 10*a* and 10*b* are joined as shown in FIG. 2. Alternatively, parts 12*a* and 12*b* may be fastened to spaced belt loops along the front of the waistband, as illustrated in FIG. 5.

Parts 12*a* and 12*b* are connected to parts 10*a* and 10*b*, respectively, or the belt loops along the front of the waistband by means of clips 20 and 22. Length adjustment means 24 and 26 on parts 12*a* and 12*b*, respectively, are adjustable to provide a tight fit, thereby highlighting the contours of the body.

Figure 3:
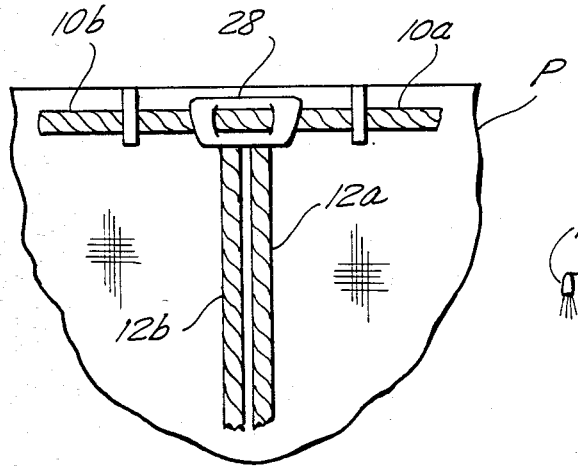
FIG. 3 is a partial view of the first preferred embodiment of the present invention showing an alternate connection means.

FIG. 3 illustrates an alternative embodiment of the connecting means illustrated as a knot in FIGS. 1 and 2. As seen in FIG. 3, an alternate embodiment of the connecting means comprises a bracket 28 which encircles first portion 10 and is movable therealong to adjust the position where the second portion 12 is connected to the first portion 10. Parts 12*a* and 12*b* extend from the bottom of bracket 28 and are connected thereto in any conventional fashion.

Figure 4:
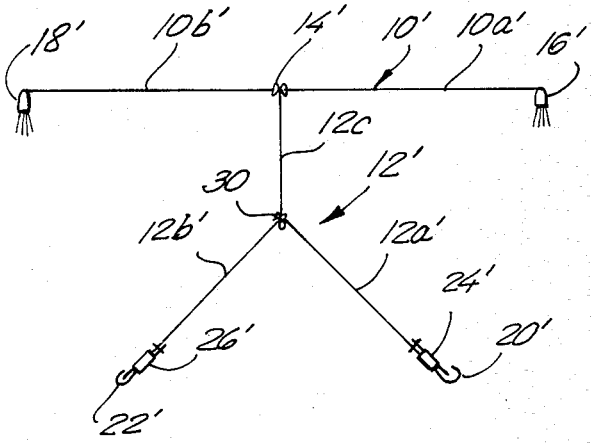
FIG. 4 is a plan view of the second preferred embodiment of the present invention.

FIG. 4 illustrates a second preferred embodiment of the present invention. The second preferred embodiment comprises a first portion 10', identical to the corresponding portion in the first preferred embodiment, including parts 10*a'* and 10*b'*, each carrying a decorative element 16' and 18', respectively. The second portion 12' of the second preferred embodiment is connected to first portion 10' by a knot 14' and includes parts 12*a'* and 12*b'* carrying clips 20' and 22', and length adjustment means 24' and 26', as in the first preferred embodiment. However, in the second preferred embodiment, parts 12*a'* and 12*b'* are shorter than the corresponding parts in the first preferred embodiment and are joined at point 30. Point 30 is, in turn, connected to connecting means 14' by a third part 12*c*, designed to extend down the seam of the seat of the pants and, particularly, between the legs.

FIG. 5 illustrates the second preferred embodiment of the present invention as used over a garment. Connecting means 14' is situated adjacent the central section of the rear of the waistband and parts 10*a'* and 10*b'* extend in opposite directions from the rear of the waistband to the front thereof to encircle the garment. Parts 10*a'* and 10*b'* may pass through belt loops on the waistband, if present. Parts 10*a'* and 10*b'* are joined together along the front of the garment by tying in a bow 15 or the like, such that the free ends thereof, to which decorative elements 16' and 18' are attached, are visible and extend downwardly along the front of the garment.

Part 12*c* extends downwardly from connecting means 14' along the seam of the seat of the pants and between the legs where point 30 is located. Parts 12*a'* and 12*b'* extend from point 30 upwardly along the front of the garment and are either connected to parts 10*a'* and 10*b'* at spaced locations on the first portion, or to spaced belt loops 17 along the front of the waistband at either side of the point where parts 10*a'* and 10*b'* are joined. Parts 12*a'* and 12*b'* are clipped onto parts 10*a'* and 10*b'* by clips 20' and 22', respectively, and the lengths thereof are adjusted by length adjusting means 24' and 26'.

FIG. 6 illustrates the preferred embodiment of a clip 20, 22 and the size adjustment means 24, 26. Clip 20 is illustrated as a hook-like element 32, which extends outwardly from a base 34 and then is curved back towards base 34 so as to partially define a recess 36. Extending outwardly from base 34 toward the free end of element 32 is a resilient member 38 which can be pressed inwardly to permit access to recess 36. When resilient part 38 is released and returns to its original position, recess 36 is completely defined by the clip. The clip serves to releasably connect the ends of the second portion with the first portion or with belt loops, as described above.

The length adjusting means comprises a buckle 40 connected to base 34. The end of the part 12*a* or 12*b* passes through spaced openings in buckle 40 and back along the interior surface thereof such that the free end portion thereof is retained adjacent the main portion of the part by a loop or ring 42 or the like. In order to adjust the size of the part, the part is pulled through the buckle 40 until the desired length is achieved. The buckle 40 will then frictionally engage the part to prevent movement of the part relative thereto.

Either of the first or second preferred embodiments of the present invention can be used in conjunction with an over-the-shoulder accessory portion. One embodiment of the over-the-shoulder accessory portion is illustrated in FIGS. 7 and 8 which show front and rear views thereof, respectively. The over-the-shoulder accessory portion comprises a first string-like part 44*a* and a second string-like part 44*b* of similar construction to first and second portions 10 and 12. Part 44*a* is provided with a clip 46 on one end thereof, and a clip 48 on the other end thereof. Similarly, part 44*b* is provided with a clip 50 on one end thereof, and a clip 52 on the other end thereof.

One end of part 44*a* is connected to part 10*b* at the front of the garment, extends diagonally across the front of the wearer, over the left shoulder, and then diagonally across the back of the wearer where it is connected to that portion of part 10*a* adjacent the rear of the waistband. Similarly, part 44*b* extends from part 10*a*, at the front of the waistband, diagonally across the front of the wearer, over the right shoulder, and then diagonally across the back of the wearer to a point at part 10*b* adjacent the rear of the waistband. Length adjustment means 54, 56 are provided on parts 44*a* and 44*b*, respectively, adjacent clips 46 and 50, in order to permit adjustment of the size of parts 44*a* and 44*b*.

FIGS. 9 and 10 illustrate a second preferred embodiment of the over-the-shoulder accessory portion. In this embodiment, parts 44*a*′ and 44*b*′ are joined at a point 58 at the front of the wearer, and point 60 at the rear of the wearer. Point 58 is connected to the first portion 10′ by means of a part 44*c* which carries a clip 60 to connect same to the first portion 10′. A size adjustment means 62 is provided in part 44*c*. At the rear, point 60 is connected to first portion or the belt loops 10′ by a part 44*d* through a clip 64. Size adjustment means 66 is provided on part 44*d* adjacent clip 64.

FIG. 11 illustrates a leg accessory portion of the present invention. This accessory includes two string-like parts 68 and 70, similar in construction to parts 10 and 12, designed to extend from the sides of portion 10, down the exterior portions of the legs of the garment to points at or above the knees. Part 68 is provided with a clip 72 for connecting to the first portion 10 at one side of the waistband and a size adjustment means 74. The bottom portion of part 64 is a loop 76 which encircles the leg. Loop 76 may be made of elastic material or the like.

Similarly, part 70 includes a clip 78 and an adjustment means 80 at the top portion thereof. At the bottom portion of part 70 is a loop 82, which may be made of elastic material, which encircles the leg.

It will now be appreciated that the present invention relates to a belt-like ornamental member comprising first and second string-like portions. The first portion is designed to encircle the waistband of a garment in belt-like fashion. The second portion is designed to extend from the first portion, between the legs, and to be connected with the first portion at spaced points thereon along the front of the waistband. Decorative elements are situated on the ends of the first portion. The second portion of the member is size adjustable and serves to emphasize the contours of the body. The basic ornamental member can be used in conjunction with an over-the-shoulder accessory portion and/or in conjunction with downwardly extending leg accessory portions to further emphasize the contours of the body of the wearer.

While only a limited number of preferred embodiments of the present invention have been disclosed herein for purposes of illustration, it is obvious that many variations and modifications could be made thereto. It is intended to cover all of these variations and modifications which fall within the scope of the present invention, as defined by the following claims:

I claim:

1. An ornamental member for use over a garment such as pants having a waistband and leg portions, the member comprising a first portion, a second portion, and means for connecting said second portion to said first portion, said first portion comprising first and second parts adapted to extend in opposite directions from the rear of the waistband to the front thereof to encircle the garment, said first and second parts being joined together, proximate the front of the waistband with the free ends thereof extending downwardly along the front of the garment, said second portion being adapted to extend downwardly along the rear of the garment from said connecting means, between the leg portions and upwardly along the front thereof, the second portion comprising third and fourth parts adapted to be connected at spaced locations proximate the front of the waistband at either side of the point where said first and second parts are joined.

2. The member of claim 1, further comprising first and second decorative elements situated on said free ends of said first and second parts, respectively.

3. The member of claim 1, further comprising first and second clip means situated on the ends of said third and fourth parts, said clip means being adapted to releasably connect said third and fourth parts with said first portion.

4. The member of claim 1, further comprising means associated with each of said third and fourth parts for adjusting the length thereof.

5. The member of claim 1, wherein said first and second portions each comprise a single string-like member.

6. The member of claim 5, wherein each string-like member comprises two or more braided strands.

7. The member of claim 1, wherein said second portion further comprises a connecting part extending betwen said connecting means and said third and fourth parts.

8. The member of claim 1, wherein said connecting means comprises a knot.

9. The member of claim 1, wherein said connecting means comprises means for adjustably positioning said second portion relative to said first portion.

10. The member of claim 1, further comprising a first accessory portion adapted to extend from spaced points on said first portion, along the rear of the waistband, over the shoulders of the wearer, to spaced points on said first portion, along the front of the waistband.

11. The member of claim 10, wherein said first accessory portion comprises fifth and sixth parts, each of which extends over a different shoulder of the wearer.

12. The member of claim 11, wherein one of said fifth and sixth parts crosses over the other of said fifth or sixth parts.

13. The member of claim 11, wherein said third portion comprises a seventh part connecting said first portion and said fifth and sixth parts.

14. The member of claim 1, further comprising a second accessory portion, said second accessory portion comprising eighth and ninth parts, each of said eighth and ninth parts extending from a different spaced point on said first portion, along the exterior of the leg of the garment and encircling a different leg of the garment at a point spaced from the waistband.

15. The member of claim 2, wherein said ornamental elements are tassels.

16. The member of claim 13, wherein said eighth and ninth parts comprise length adjustment means.

17. The member of claim 1, wherein said first and second portions each comprise a chain.

18. The member of claim 1, wherein said garment has spaced belt loops along the front thereof and further comprising first and second clip means associated with said first and second parts, respectively, said first and second clip means being adapted to releasably connect said third and fourth parts to said belt loops, respectively.

* * * * *